US012566002B2

(12) United States Patent
Kololuoma et al.

(10) Patent No.: US 12,566,002 B2
(45) Date of Patent: Mar. 3, 2026

(54) METHOD TO CREATE A MICROCLIMATE AND A MICROCLIMATE CREATING HEATING SYSTEM

(71) Applicant: THE WARMING SURFACES COMPANY OY, Oulu (FI)

(72) Inventors: Terho Kololuoma, Oulu (FI); Jani-Mikael Kuusisto, Tampere (FI); Jarno Vehmas, Rovaniemi (FI)

(73) Assignee: THE WARMING SURFACES COMPANY OY, Oulu (FI)

( * ) Notice: Subject to any disclaimer, the term of this patent is extended or adjusted under 35 U.S.C. 154(b) by 333 days.

(21) Appl. No.: 18/194,826

(22) Filed: Apr. 3, 2023

(65) Prior Publication Data

US 2024/0328637 A1 Oct. 3, 2024

(51) Int. Cl.
*F24D 19/10* (2006.01)
*F24D 13/02* (2006.01)

(52) U.S. Cl.
CPC ..... *F24D 19/1096* (2013.01); *F24D 13/024* (2013.01)

(58) Field of Classification Search
CPC ..... F24D 19/1096; F24D 13/024; H05B 3/26; H05B 2203/026; H05B 1/0275; H05B 3/20
See application file for complete search history.

(56) References Cited

U.S. PATENT DOCUMENTS

2014/0355968 A1 12/2014 Tsai et al.
2017/0191675 A1 7/2017 Marti Fibla, Gurgo et al.
2021/0080121 A1 3/2021 Kollmann et al.
2021/0294066 A1 9/2021 Hirata et al.
2022/0322519 A1 10/2022 Tsai et al.

FOREIGN PATENT DOCUMENTS

| | | | | |
|---|---|---|---|---|
| CN | 109869802 A | * | 6/2019 | |
| CN | 211459546 U | * | 9/2020 | ..... A47C 27/085 |
| EP | 1797743 B1 | | 3/2019 | |
| EP | 3443810 B1 | | 5/2022 | |
| KR | 100915211 B1 | | 9/2009 | |
| KR | 101626359 B1 | | 6/2016 | |

(Continued)

OTHER PUBLICATIONS

International Search Report for Application No. PCT/FI2024/050150 dated Sep. 19, 2024.

(Continued)

*Primary Examiner* — Kun Kai Ma

(74) *Attorney, Agent, or Firm* — Robert P. Michal, Esq.; Rimon PC

(57) ABSTRACT

A method and a system for controlling temperature of an indoor space. The space is provided with a conventional heating system and a heater matrix including a plurality of heater pixels embedded in surfaces included in the space. Each heater pixel includes a resistive heater element. The conventional heating system is used for maintaining a basic temperature of the space, the basic temperature being less than a comfortable room temperature. Operation of the heating matrix is selectively controlled for generating one or more areas within the space that have a microclimate with a comfort temperature that is higher than the basic temperature.

15 Claims, 5 Drawing Sheets

(56) References Cited

FOREIGN PATENT DOCUMENTS

| | | | |
|---|---|---|---|
| KR | 20200009660 | A | 1/2020 |
| WO | 2015151905 | A1 | 10/2015 |
| WO | 2022039020 | A1 | 2/2022 |
| WO | 2022234189 | A1 | 11/2022 |
| WO | 2022246878 | A1 | 12/2022 |

OTHER PUBLICATIONS

International Search Report dated Jun. 17, 2024, issued in corresponding International Application No. PCT/FI2024/050077, 3 pages.
Written Opinion of the International Searching Authority dated Jun. 17, 2024, issued in corresponding International Application No. PCT/FI2024/050077, 7 pages.
Finnish Search Report issued by the Finnish Patent and Registration Office in corresponding Finnish Application No. 20235486, dated Dec. 19, 2023, 2 pages.

* cited by examiner

METHOD TO CREATE A MICROCLIMATE AND A MICROCLIMATE CREATING HEATING SYSTEM

FIELD

The present invention relates to a method, and a system related to heating a space, in particular an indoor space. More particularly, the invention relates to a heating system that creates microclimate areas that have locally increased temperature and/or intensity of thermal radiation.

BACKGROUND

Recently, increasing energy prices have made people more cost conscious. It is well known, that decreasing the indoor temperature reduces energy consumption. For example, energy costs are decreased by 5% per centigrade indoor temperature decreased. Lower energy consumption reduces $CO_2$ emissions. Electricity is the most common type of green energy produced by utilizing renewable energy sources, such as solar, wind, low-impact hydro facilities, geothermal and biomass, because green electricity is easy to produce and easy to deliver to consumers.

Keeping room temperature lower when the space is empty and increasing the temperature to a comfort temperature when the space is occupied leads to energy savings. Comfort temperature varies from person to person. Too low or too high temperature in a room or other indoor space results discomfort and reduced working efficiency. Unfortunately, temperature control in existing indoor heating systems is too slow for altering temperature profile of a space according to occupancy and they can be only controlled in room level hence not allowing local differences within the space.

DESCRIPTION OF THE RELATED ART

Heating of indoor spaces is traditionally performed using centralized, slow response heater systems, such as convection based warm air generators and electrical heaters. Electrical floor heaters are installed within concrete or under the flooring material. Electrical roof heaters radiate heat to the space from above. Design of centralized heating systems for example for office spaces in which layout may be altered by utilizing moveable walls such as office screens is challenging, because moveable structures within the space inhibit heat conduction. Although various moveable, electrically operated heater devices like moveable radiators may be used for warming smaller areas, moveable heating devices are clumsy.

SUMMARY

An object is to provide a method and apparatus so as to solve the problem of saving energy while heating an indoor space without compromising comfort of inhabitants.

The preferred embodiments of the invention are disclosed in the dependent claims.

The present invention is based on the idea of a heater matrix containing a plurality of heater units called heater pixels with individually controllable radiation intensity. The heater matrix is controlled by a control unit and one or more sensing units. Heater pixels of the heater matrix are coupled to a power source by a power channel and one or more information channels enable controlling operation of the heater units.

According to a first aspect, a method of controlling temperature of a space provided with a conventional heating system and a heater matrix is provided. The heater matrix comprises a plurality of heater pixels embedded in surfaces comprised in the space. Each heater pixel comprising a resistive heater element. The method comprises maintaining, by the conventional heating system, a basic temperature of the space, wherein the basic temperature is less than a comfortable room temperature, and selectively controlling operation of the heater matrix for generating one or more areas within the space that have a microclimate with a comfort temperature that is higher than the basic temperature.

According to some aspects, said selective operation control of the heater matrix comprises controlling operation of one or more of said heater pixels of the heater matrix individually and/or controlling operation of one or more of said heater pixels of the heater matrix as a group.

According to some aspects, one or more of said heater pixels comprises a temperature sensor. The method comprises controlling amount of electrical power fed to the one or more heater pixels based on temperature detected by the respective temperature sensor.

According to some aspects, the basic temperature is 19° C. or less, preferably 18° C. or less, more preferably 17° C. or less, most preferably 16° C. or less. A comfort temperature is typically at least 20° C., preferably at least 21° C.

According to some aspects, the method further comprises receiving control information in response to a user operating a user interface or a user device, and activating operation of the heater matrix based on said control information.

According to some aspects, the method further comprises determining whether at least one person causing activating operation of the heater matrix can be identified. If the at least one person is identified, the method comprises obtaining personalized settings of the identified person and controlling operation of the heater matrix at least partly according to the personalized settings of the identified person. If no persons causing activating operation of the heater matrix can be identified, the method comprises obtaining general settings and controlling operation of the heater matrix according to the general settings.

According to some aspects, the method further comprises determining, based on sensor signals received from one or more sensors, that the space is occupied, and activating operation of the heater matrix in response to said determining that the space is occupied.

According to some aspects, the method comprises, upon determining, that the space is occupied, obtaining further sensor signals in effort to identify at least one person occupying the space. If the at least one person is identified, the method comprises obtaining personalized settings of the identified person and controlling operation of the heater matrix at least partly according to the personalized settings of the identified person. If none of the one or more persons occupying the space can be identified, the method comprises obtaining general settings and controlling operation of the heater matrix according to the general settings.

According to some aspects, selectively controlling operation of the heater matrix comprises obtaining settings of the heater matrix, wherein the settings determine that at least one heater pixel is not to be activated due to being collocated with furniture.

According to aspects of the invention, a heating system comprising a conventional heating system, and a microclimate heating system comprising a controller at least one sensor and a heater matrix are provided. The heater matrix comprises a plurality of heater pixels embedded in surfaces comprised in the space, each heater pixel comprising a resistive heater element. The conventional heating system is configured to maintain a basic temperature of the space, the basic temperature being less than a comfortable room temperature. The controller is configured to selectively control operation of the heater matrix for generating one or more areas within the space that have a microclimate with a comfort temperature that is higher than the basic temperature.

According to some aspects, said selective operation control of the heater matrix comprises controlling operation of one or more of said heater pixels of the heater matrix individually and/or controlling operation of one or more of said heater pixels of the heater matrix as a group.

According to some aspects, one or more of said heater pixels comprises a temperature sensor. The controller is configured to receive sensor data from the temperature sensors of one or more heater pixels, and the controller is configured to control amount electrical power fed to the respective one or more heater pixels based on temperature detected by the respective temperature sensor.

According to some aspects, the system comprises at least one of a user interface and a user device. The controller is configured to activate operation of the heater matrix based on control information received in response to a user operating the user interface or the user device.

According to some aspects, the controller is configured to determine, whether at least one person causing activating operation of the heater matrix can be identified. If the at least one person is identified, the controller is configured to obtain personalized settings of the identified person from a memory, and to control operation of the heater matrix at least partly according to the personalized settings of the identified person. If no person causing activating operation of the heater matrix can be identified, the controller is configured to obtain general settings from a memory, and to control operation of the heater matrix according to the general settings.

According to some aspects, the system further comprises at least one sensor selected from the group comprising a moisture sensor, a capacitive sensor, a particle sensor, a strain sensor, a chemical sensor such as a volatile organic compound (VOC) sensor. The controller is further configured to determine, based on sensor signals received from one or more sensors, that the space is occupied, and to activate operation of the heater matrix in response to said determining that the space is occupied.

According to some aspects, the controller is further configured, upon determining, that the space is occupied, to obtain sensor signals in effort to identify at least one person within the space. If the controller is able to identify the at least one person, the controller is configured to obtain personalized settings of the identified person from a memory and to control operation of the heater matrix according to the personalized settings of the identified person. If the controller is not capable of identifying any of the one or more persons occupying the space, the controller is configured to obtain general settings from the memory and to control operation of the heater matrix according to the general settings.

According to some aspects, settings of the heater matrix determine at least one heater pixel that is not to be activated due to being collocated with furniture.

According to some aspects, the carrier material of heater pixels is one or more of a fiber based materials such as paper or cardboard, glass-fiber, carbon fiber, textiles, fabrics made of textiles, polymer fibers, fiber reinforced materials made with polymer fibers, laminates such as high-pressure laminates, glass fiber composites, polymeric materials, films, inorganic materials such as concrete and ceramics.

The present invention has the advantage that it enables saving of energy by maintaining low indoor temperatures when the space is empty and it reacts quickly on person(s) entering into the space. The system may even recognize the entering person and set the feeling of warmth at desired locations within the space according to the person's preferences.

Embodiments of the invention enable reduction in energy required for heating of indoor spaces, such as houses and rooms. The heater matrix covering large surfaces in the space changes the feeling of warmth so that the overall temperature can be lower in comparison to existing point-like heat sources such as radiators or convection-based heating systems like heat-pump air blowers. Temperature can be adjusted according to a person's preference(s) via individually controlled heater pixels.

BRIEF DESCRIPTION OF THE DRAWINGS

In the following the invention will be described in greater detail, in connection with preferred embodiments, with reference to the attached drawings, in which.

DETAILED DESCRIPTION

In this context, "comfort temperature" refers to a temperature that most people prefer for indoor settings. It feels comfortable to a person when they are wearing typical indoor clothing.

In this context, "basic temperature" refers to a temperature that is lower than a comfort temperature.

In this context, an indoor space, also referred to in short as a space, refers to a house, room or equivalent that can be heated using any conventional heating system.

Figure 1:
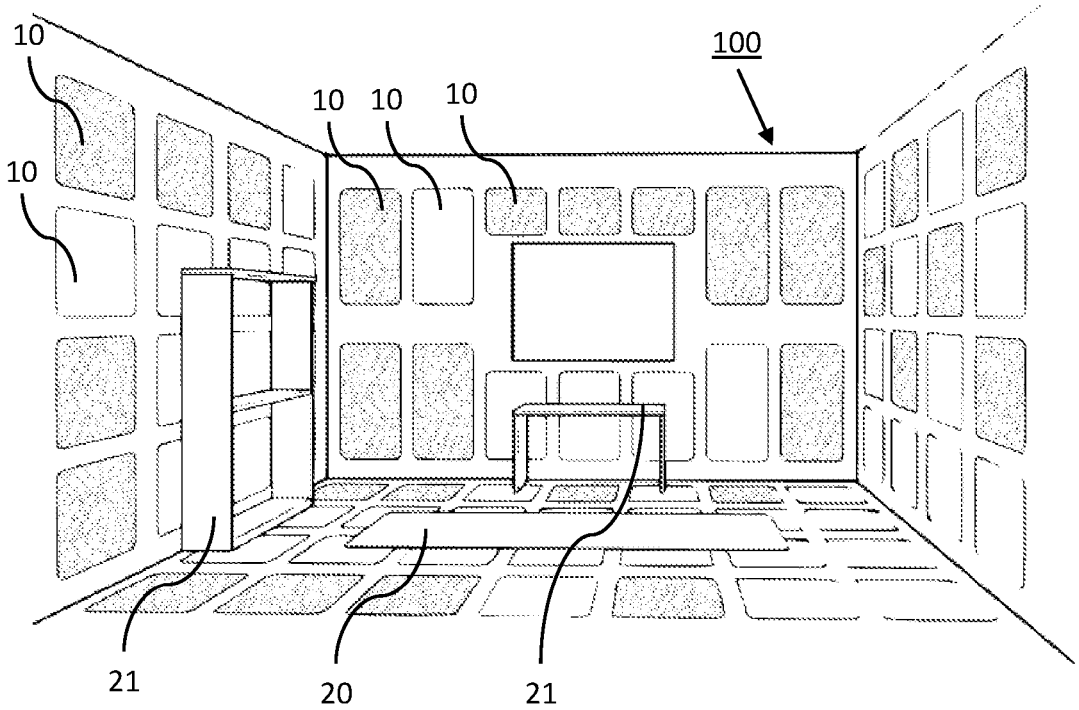
FIG. 1 illustrates a room comprising a heater matrix with a plurality of heater pixels.

The FIG. 1 illustrates a room comprising a heater matrix.

The heater matrix 100 comprises a plurality of resistive heater elements referred herein as heater pixels 10. Each heater pixel 10 represents a cell of the heater matrix 100. Heater pixels 10 can have any size and/or shape and they can be controlled individual or as groups.

Heater pixels 10 may be embedded in any suitable interior decoration material sheet. In this example, heater pixels 10 are provided at walls and at the floor, embedded in carrier materials installed on the wall and the floor, respectively. For example, heater pixels 10 at the walls may be embedded in any fiber based materials, such as paper, cardboard, glass-fiber, carbon fiber, textiles and fabrics made of them, polymer fibers and fiber reinforced materials made with the help of them. Such materials may include laminates such as high-pressure laminates, glass fiber composites etc. Heater pixels may be also integrated with polymeric materials and films as well as inorganic materials such as concrete and ceramics. Preferably, heating pixels are invisible in the room, in other words hidden behind a visible surface layer or layers of the respective carriers. In the FIG. 1, selective activation is illustrated by showing active heater pixels 10 with a pattern whereas inactive heater pixels 10 are white, outlined areas.

Heater pixels 10 may be controlled individually. This enables controlling heating pixels 10 inactive when collocated with furniture 21 or a rug 20, as illustrated in the FIG. 1. On the other hand, one or more heater pixels located next to a piece of furniture 21 where a person often spends time, like an office desk, is preferably activated to create a comfortable microclimate with a comfort temperature. Heater pixels 10 may also be embedded in furniture. For example, a sofa or a chair may comprise one or more heater pixels embedded in furniture upholstery fabric covering the sofa.

Figure 2:
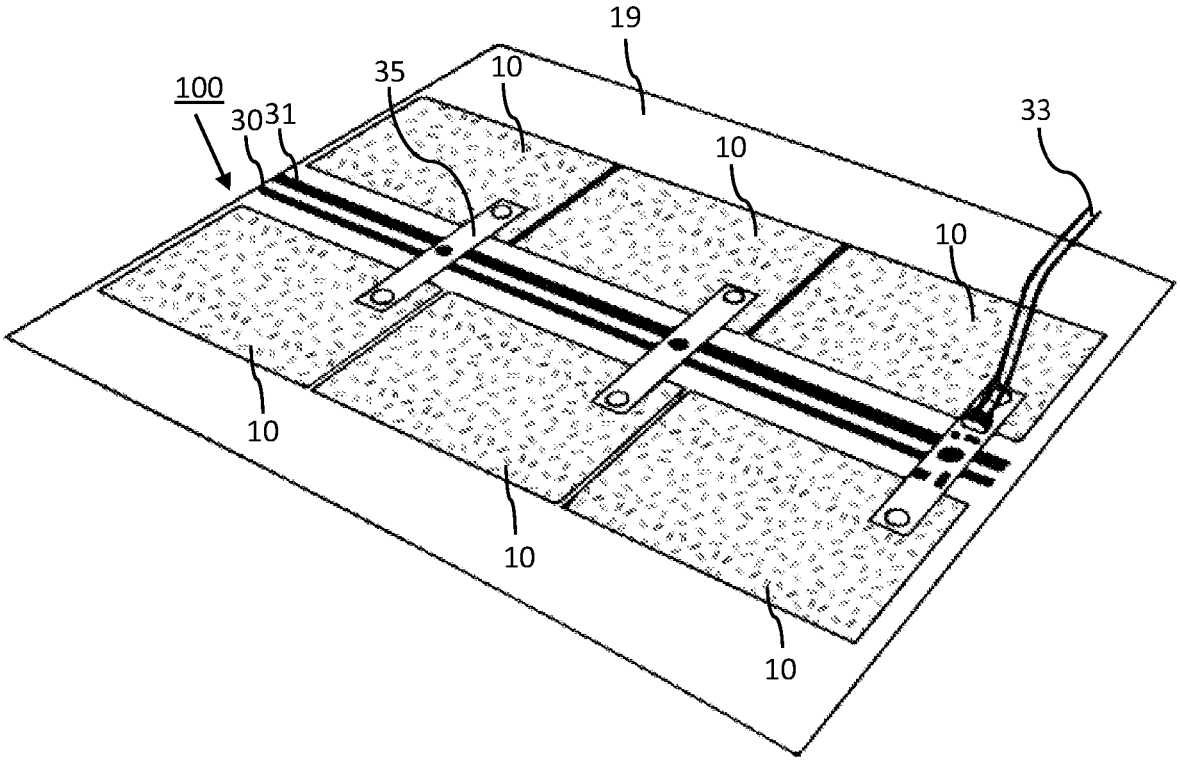
FIG. 2 illustrates a back side of an exemplary heater matrix embedded in a carrier.

The FIG. 2 illustrates a simplified view of a back side of an exemplary heater matrix 100 embedded in a carrier. This small exemplary heating matrix may be implemented on a piece of any suitable building board 19, such as a laminate acting as the carrier.

Each heater pixel 10 comprises a resistive heater element patterned out of conductive material. Conductive material is preferably metallic, such as Al, Ni, Cu, Fe, Zn or an alloy such as brass, bronze, German silver or their derivative such as phosphorous bronze etc. Conductive material may also be applied in a printed form. In such case, inks made of silver, carbon or copper or their mixtures may be used. The resistive heater element is configured to be heated by controllably feeding electric current therein. The conductive material layer of the heater pixel 10 is thin. The resistive heater element may be manufactured by printing, or by using converting technologies such as die cutting known in packaging industry or by using other roll-to-roll manufacturing technologies such as laser patterning, etching and dry-etching, all of which enable generating a thin, patterned layer of the conductive material. In this context, thin refers to a layer of conductive material of the order of 0.5 to 50 micrometers. In some examples, the layer of conductive material is of the order of 10 to 30 micrometers. In some other layer structures, the layer of conductive material is of the order of 10 to 20 micrometers.

In the FIG. 2, electrical connections for resistive heater elements of the heater pixels 10 are provided by bridge coupling elements 35 electrically connected to a ground feed line 30 and an operating voltage feed line 31 further coupled by wiring 33 to a power source (not shown). Ground feed line 30 and operating voltage feed line 31 are also made of conductive material, and according to some embodiments, these can be printed, manufactured by using converting technologies known from printing and packaging industry such as die- or kiss cutting or laser patterning, or using traditional electronics manufacturing technologies, such as etching and dry-etching. Conductivity of feed lines 30, 31 is preferably better than conductivity of resistive heater elements of heater pixels 10 so that feed lines 30, 31 do not significantly heat when heater pixels 10 are active.

A roll-to-roll manufacturing method can be applied to facilitate mass production of the plurality of heater pixels 10. An exemplary method for manufacturing patterned resistive heater elements useable in heat pixels 10 is disclosed in international patent application WO 2022/234189. A plurality of heater pixels 10 is electrically connected to create the heater matrix 100. Electrical connections, for heater pixels 10, such as feed lines 30, 31, may be created at least partially during the manufacturing process of heater pixels 10, but electrical connections may also be created after the manufacturing process of heater pixels 10.

Heater pixels 10 are preferably integrated into various interior building or decoration materials useable as a carrier of the heater matrix 100. Heater pixels 10 may be integrated to fabrics, such as furniture upholstery fabric, curtains, blinds, decoration fabrics and textiles, or laminates, such as flooring laminates and fiber enforced composites such as glass fiber. Preferably, the conductive material pattern is disposed close to the outer surface of the carrier such that there is only a thin layer of material or materials between the conductive material pattern and the outer surface of the interior decoration material. This reduces power loss in material layers between the heater pixel and the space it is intended to warm up.

Figure 3A:
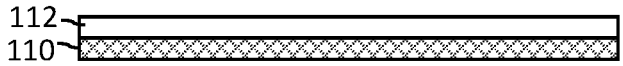
FIGS. 3*a*, 3*b*, 3*c* and 3*d* illustrate various carrier materials with embedded heater pixels.
Figure 3B:
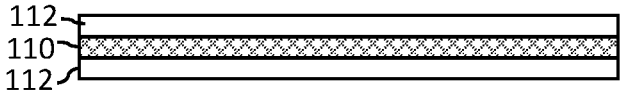
Figure 3C:
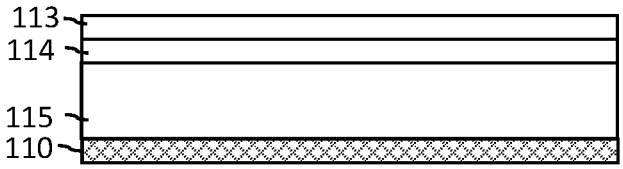

FIGS. 3*a* to 3*c* illustrate cross-sections of exemplary building material sheets with a layer of resistive heater element 110 of a heating pixel. Drawings are not in scale.

FIG. 3*a* illustrates a fabric, such as a furniture upholstery fabric. Resistive heating element 110 is attached on the back side of the layer of fabric 112. According to some embodiments, the resistive heating element 110 is adhesively attached to the fabric 112.

FIG. 3*b* illustrates a fabric in which resistive heating element 110 is embedded between two fabric layers. Fabric layers may be the same type of fabric or different types of fabric.

FIG. 3*c* illustrates a laminate, such as a laminate flooring, according to some embodiments. The laminate typically comprises a plurality of thin material layers, such as an applique layer 114 and a clear protective layer 113. The resistive heating element 110 is attached on the back of the core layer 115. According to some embodiments, the resistive heating element 110 is adhesively attached on the back of the core layer 115.

Figure 3D:
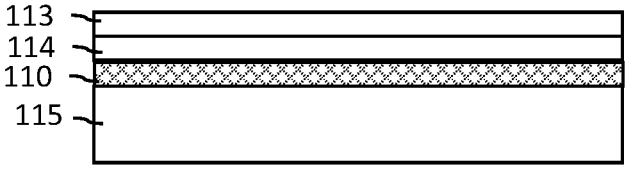

FIG. 3*d* illustrates another exemplary laminate. The resistive heating element 110 is between the applique layer 114 and a core layer 115. According to some embodiments, the resistive heating element 110 is adhesively attached between the applique layer 114 and a core layer 115.

Figure 4:
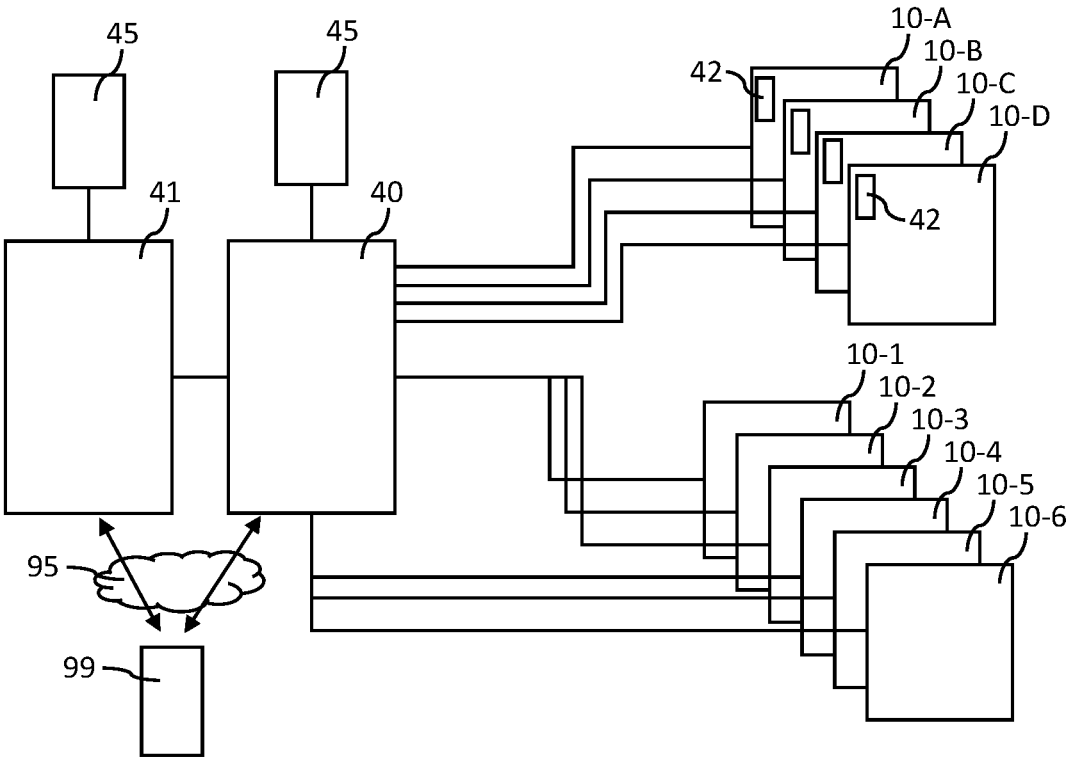
FIG. 4 illustrates a system for controlling heating using a heater matrix.

FIG. 4 illustrates a system for controlling heating using a heater matrix according to some embodiments.

For generating the heater matrix, each heater pixel 10 is communicatively connected to a control unit 40. Heater pixels may be connected to the control unit 40 either individually, as heater pixels 10-A, 10-B, 10-C, 10-D or as one or more groups of heater pixels. In this non-limiting example, heater pixels 10-1, 10-2 and 10-3 are arranged as one group and heater pixels 10-4, 10-5 and 10-6 are arranged as another group. When a heater pixel is connected individually to the control unit, it can be controlled individually. When more than one heater pixels are connected to the control unit as a group, they are controlled as a group.

Sensors are provided in the system for enabling precise control of the radiative power per heater pixel or per heater pixel group. Preferably, sensors are used for detecting presence and/or position of a person or persons within the space. In some embodiments, sensors are also provided for recognize a person or group of people within the space.

As illustrated in the FIG. 4, temperature sensors 42, such as NTC, PTC or thermocouple sensors may be provided in association with one or more heater pixels 10. Temperature sensors 42 provide temperature data that is localized to the respective heater pixel and thus enable controlling of operating power of heater pixels to produce desired temperature at each individual heating pixel. Also, other types of sensors, such as one or more of a moisture sensor, a capacitive sensor, a particle sensor, a strain sensor, a chemical sensor such as a volatile organic compound (VOC) sensor, may be provided in association with one of more heater pixels 10.

According to some embodiments, one or more sensors 45 may be directly or indirectly coupled to the control unit 40. Said one or more sensors 45 may be selected from a group comprising a capacitive sensor, a light sensor, such as a photodiode, a motion sensor and a heat sensor. Such sensors may be used for example for determining presence of a person or persons in a space that has a heater matrix. The heat pixel may furthermore comprise one or more haptic elements configured to operate as part of a user interface. According to some embodiments, one or more sensors 45 directly or indirectly coupled to the control unit 40 may be configured to identify a person within the space. By identifying the person, the system may apply personalized settings for comfort temperature(s) and/or microclimate(s) within the space. Such personalized settings may determine temperature of any individual heater pixel so that in addition to adjusting temperature(s) to the desired comfort temperature(s) of the identified person, also locations of microclimates within the space can be individually determined. For example, the person may wish to have a slightly lower temperature at an office table or at a bed, and a slightly higher temperature at a sofa.

The control unit may further be connected to a central unit 41, which may be configured to communicate with external systems and databases. According to some embodiments, the central unit 41 enables remote control and/or remote data processing. For enabling remote control and/or remote data processing, the central unit 41 is preferably provided with one or more data communication interfaces.

According to some embodiments, the control unit 40 and/or the is central unit 41 is configured to provide wireless communications 95 with a mobile communication apparatus 99. The mobile communication apparatus 99 may be a remote controller, a mobile phone, a tablet computer or like. According to some embodiments, the mobile communication apparatus 99 is provided with an application program that provides a user interface for remotely controlling the heater matrix. The application program may also provide a user interface for determining general settings and/or personalized settings. Such settings determine which heater pixels 10 are to be activated and what is the target temperature of each active heater pixel 10.

Figure 5:
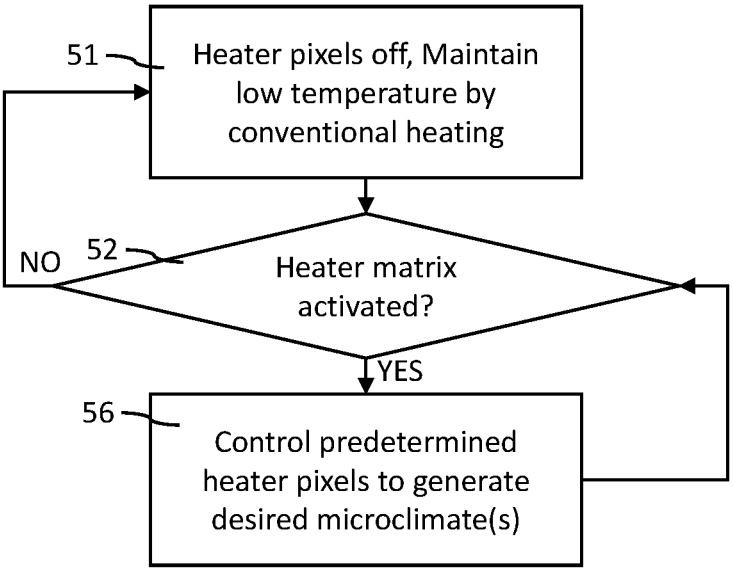
FIG. 5 illustrates a method of controlling heating of a space with a heater matrix.

FIG. 5 illustrates a first method of controlling heating of a space according to some embodiments.

In the step 51, only the conventional heating is on. Temperature of the space is maintained in basic temperature, in other words in temperature range that is below a comfort temperature range.

A user may activate the heater matrix manually by means of a user interface, which may be a simple, mechanic switch, a smart card reader device, a short range wireless tag reader device or like, or an interface of an intelligent home control system, or he/she may use remote control. According to some embodiments, remote control of the heater matrix is provided by a dedicated remote controller apparatus, or remote control is implemented as a mobile phone application program.

As soon as the user activates the heater matrix in the step 52 the control unit obtains a predetermined settings from a memory and activates heater pixels accordingly to generate desired microclimate(s) with desired comfort temperature(s) within the space in the step 56. Obtained settings determine a heating pattern, which preferably determines which heater pixels are activated and also a predefined temperature for each active heater pixel and/or heater pixel group.

When heater pixels are active in the step 56, the controller controls operation of heater pixels to maintain temperature at each active heater pixel at desired comfort temperature as determined in settings stored in a memory associated or included in the controller, thus creating and maintaining the desired microclimate(s) within the space, and continues scanning sensor signals, whether the space is still occupied.

As soon as the controller determines in the step 52, that the user has inactivated the heater matrix, the controller switches all heater pixels off so that only the conventional heating system provides heating energy into the space. In comparison to normal use of the conventional heating system, temperature of the unoccupied space can be greatly reduced from a comfortable room temperature to a basic temperature, which results in energy savings.

Figure 6:
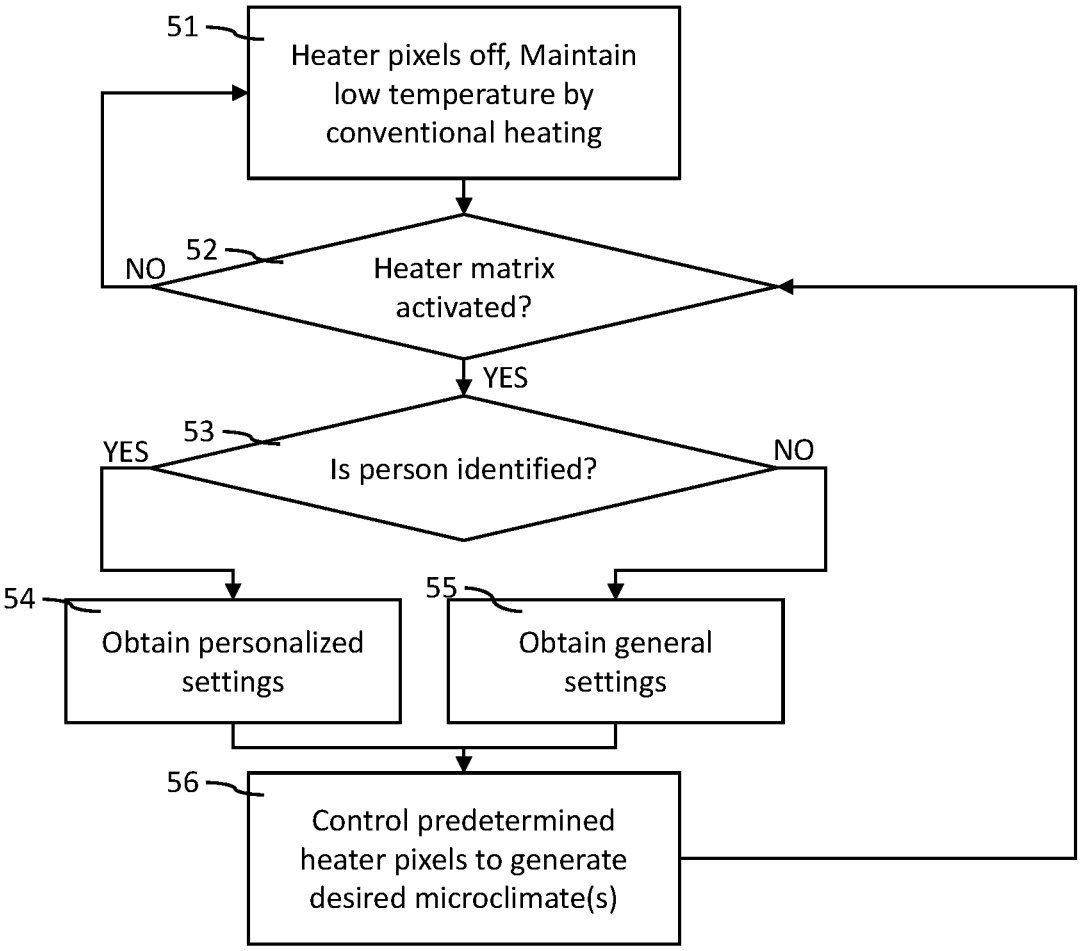
FIG. 6 illustrates a method of controlling heating of a space with a heater matrix.

FIG. 6 illustrates a method of controlling heating of a space according to some embodiments. In this embodiment, comfort heat generated by the heater matrix is adjusted according to a person's preferences.

Steps common with those described in connection to FIG. 5 are similar as explained above.

In this embodiment, upon detecting that the heater matrix is activated in step 52, it is further determined in the step 53, whether the person activating the heater matrix can be identified. Identification of a person may be based for example on identifying a user device used for activating the heater matrix. According to some embodiments, identification of a person is based on detecting smart card, or a tag, which may be carried by a person for example in any type of active or passive mobile device, or a code entered by the person in a user interface. Further, any suitable sensor or sensors within or associated with the space may be used for identifying the person.

If the person can be identified, a set of personalized settings predefined for this specific person are obtained from a memory of the controller in the step 54. On the other hand, if the person cannot be identified, a set of general settings are obtained from a memory of the controller in the step 55.

These obtained settings, either personalized or general ones, are then applied to control operation of the heater matrix in the step 56.

Figure 7:
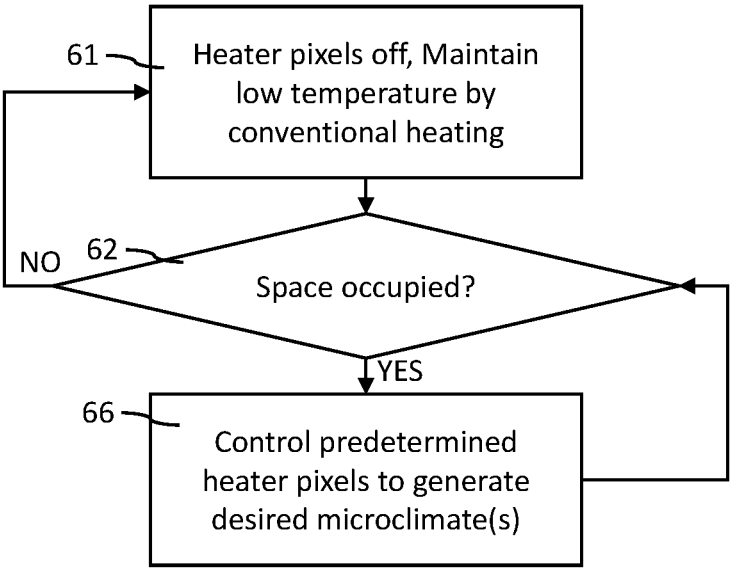
FIG. 7 illustrates a method of controlling heating of a space with a heater matrix.

FIG. 7 illustrates a first method of controlling heating of a space according to some embodiments.

In the step 61, only the conventional heating is on. Temperature of the space is maintained in basic temperature, in other words in temperature range that is below a comfort temperature range.

According to some embodiments, the system uses one or more sensor signals to determine whether the space is occupied by one or more persons. The controller 40 continuously or intermittently scans and processes sensor signals to determine whether the space is occupied. For determining whether the space is occupied, sensor signals from one or more sensors may be used for determining presence of one or more persons within the space, and/or sensor signals form one or more sensors may be used for determining that one or more persons is entering the space.

As soon as it is detected in the step 62 that the space is occupied by at least one person, in other words presence of at least one person is detected, based on sensor signals obtained from at least one sensor associated with one or more heater pixels and/or at least one sensor connected to the control unit, the control unit obtains a predetermined settings from a memory and activates heater pixels accordingly to generate desired microclimate(s) with desired comfort temperature(s) within the space in the step 66. Obtained settings determine a heating pattern, which preferably determines which heater pixels are activated and also a predefined temperature for each active heater pixel and/or heater pixel group.

When heater pixels are active in the step 66, the controller controls operation of heater pixels to maintain temperature at each active heater pixel at desired comfort temperature as determined in settings stored in a memory associated or included in the controller, thus creating and maintaining the desired microclimate(s) within the space, and continues scanning sensor signals, whether the space is still occupied.

As soon as the controller determines in the step 62, that the space is not occupied, in other words no presence of persons is detected within the space, the controller preferably switches all heater pixels off so that only the conventional heating system provides heating energy into the space. In comparison to normal use of the conventional heating system, temperature of the unoccupied space can be greatly reduced from a comfortable room temperature to a basic temperature, which results in energy savings.

When a person enters the space, this is detected by the controller on basis of one or more sensor signals, and the heater matrix is activated again for creating comfort heat to create comfort temperature(s) in wanted areas of the room.

Figure 8:
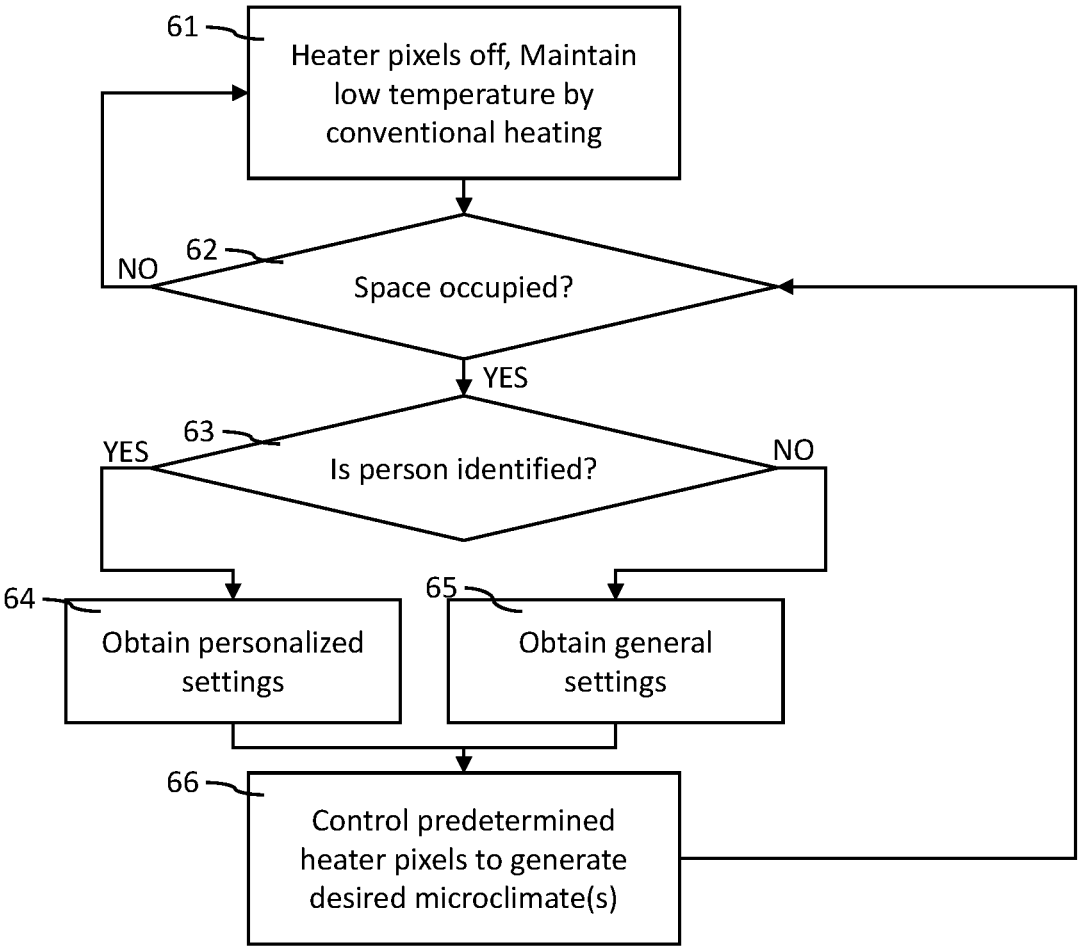
FIG. 8 illustrates a method of controlling heating of a space with a heater matrix.

FIG. 8 illustrates a method of controlling heating of a space according to some embodiments. In this embodiment, comfort heat generated by the heater matrix is adjusted according to a person's preferences.

Steps common with those described in connection to FIG. 7 are similar as explained above.

In this embodiment, after detecting presence of a person in step 62, it is further determined in the step 63, whether the person can be identified. Identification of a person may be based for example directly based on personal physical attributes such as size, weight or by an activity of the person, such as switching on the heater matrix using a particular user device, or performing a predetermined maneuver, or by use of any known type of indirect identification such as detecting a smart card, a tag or a code, which may be carried by a person for example in any type of active or passive mobile device.

If the person can be identified, a set of personalized settings predefined for this specific person are obtained from a memory of the controller in the step 64. On the other hand, if the person cannot be identified, a set of general settings are obtained from a memory of the controller in the step 65.

These obtained settings, either personalized or general ones, are then applied to control operation of the heater matrix in the step 66.

Figure 9:
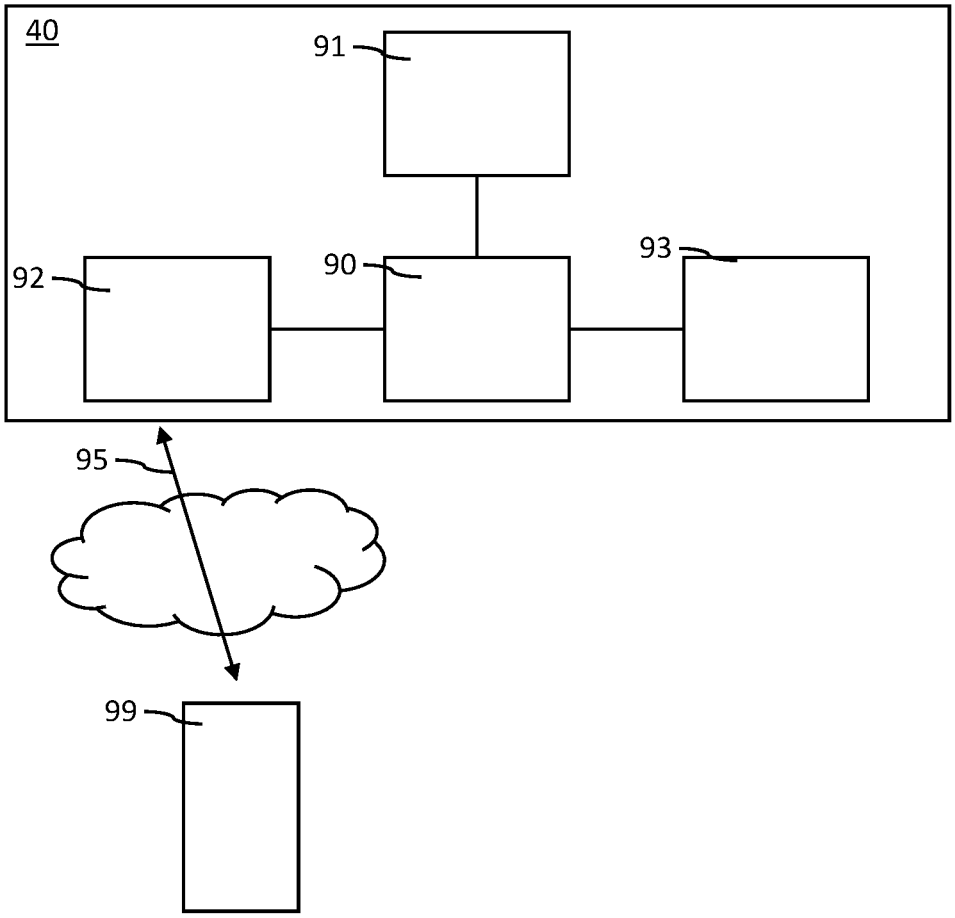
FIG. 9 illustrates functional elements of a controller.

FIG. 9 illustrates functional elements of a controller 40. The controller comprises at least one processor 90 and at least memory 91 comprising program code which, when executed by the processor, causes the processor 90 to perform steps for controlling the heater matrix. The controller 40 comprises or is provided with at least one of a user interface 92 and a wireless communication interface unit 93, for enabling a user to enter and adjust settings for controlling the heater matrix using one of the user interface 92 and remote control utilizing wireless communication with the controller 40. Settings, which comprise at least one of general settings and personalized settings are preferably stored in the memory 91. Settings determine which heater pixels of the heater matrix are to be activated and what is the desired temperature of each active heater pixel. According to some embodiments, the wireless communication interface unit 93 is configured for wireless communication 95 with a mobile communication apparatus 99 such as a mobile phone, tablet computer or like. Alternatively, the mobile communication apparatus may be a dedicated remote controller. According to some embodiments, an application program is provided in the mobile communication apparatus 99 for entering and adjusting settings. Wireless communication between the at least one wireless communication interface unit 93 and the mobile communication apparatus 99 may be implemented using any applicable wireless communication method, such as NFC, Bluetooth, Wi-Fi, 3G, 4G, 5G or 6G cellular communication, and/or a proprietary wireless communication method.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A method of controlling temperature of a space provided with a conventional heating system and a heater matrix comprising a plurality of heater pixels embedded in surfaces comprised in the space, each heater pixel comprising a resistive heater element, the method comprising:

maintaining, by the conventional heating system, a basic temperature of the space, wherein the basic temperature is less than a comfortable room temperature, selectively controlling operation of the heater matrix for generating one or more areas within the space that have a microclimate with a comfort temperature that is higher than the basic temperature, receiving control information in response to a user operating a user interface or a user device, and activating operation of the heater matrix based on said control information, determining whether at least one person causing activating operation of the heater matrix is identified, and in response to identifying the at least one person, obtaining personalized settings of the identified person, and controlling operation of the heater matrix at least partly according to the personalized settings of the identified person, and in response to no persons causing activating operation of the heater matrix is identified, obtaining general settings and controlling operation of the heater matrix according to the general settings.

2. The method according to claim 1, wherein said selective operation control of the heater matrix comprises:

controlling operation of one or more of said heater pixels of the heater matrix individually and/or controlling operation of one or more of said heater pixels of the heater matrix as a group.

3. The method according to claim 1, wherein one or more of said heater pixels comprises a temperature sensor, and wherein the method comprises:

controlling amount of electrical power fed to the one or more heater pixels based on temperature detected by the respective temperature sensor.

4. The method according to claim 1, wherein the basic temperature is 19° C. or less.

5. The method according to claim 1, further comprising:
determining, based on sensor signals received from one or more sensors, that the space is occupied, and
activating operation of the heater matrix in response to said determining that the space is occupied.

6. The method according to claim 5, further comprising:
upon determining, that the space is occupied, obtaining further sensor signals in effort to identify at least one person occupying the space, and in response to identifying the at least one person, obtaining personalized settings of the identified person, and controlling operation of the heater matrix at least partly according to the personalized settings of the identified person, and
in response to not identifying the one or more persons occupying the space, obtaining general settings and controlling operation of the heater matrix according to the general settings.

7. The method according to claim 1, wherein selectively controlling operation of the heater matrix comprises:
obtaining settings of the heater matrix, wherein said settings comprise determining that at least one heater pixel is not to be activated due to being collocated with furniture.

8. A heating system comprising a conventional heating system, and a microclimate heating system comprising a controller, at least one sensor and a heater matrix comprising a plurality of heater pixels embedded in surfaces comprised in the space, each heater pixel comprising a resistive heater element, wherein the conventional heating system is configured to maintain a basic temperature of the space, the basic temperature being less than a comfortable room temperature, and wherein the controller is configured to selectively control operation of the heater matrix for generating one or more areas within the space that have a microclimate with a comfort temperature that is higher than the basic temperature, wherein the system comprises at least one of a user interface and a user device, and wherein the controller is configured to activate operation of the heater matrix based on control information received in response to a user operating the user interface or the user device, and wherein the controller is configured:
to determine, whether at least one person causing activating operation of the heater matrix is identified, and
in response to identifying the at least one person, the controller is configured to obtain personalized settings of the identified person from a memory, and to control operation of the heater matrix at least partly according to the personalized settings of the identified person, and
in response to no persons causing activating operation of the heater matrix is identified, the controller is configured to obtain general settings from a memory, and to control operation of the heater matrix according to the general settings.

9. The heating system according to claim 8, wherein said selective operation control of the heater matrix comprises controlling operation of one or more of said heater pixels of the heater matrix individually and/or controlling operation of one or more of said heater pixels of the heater matrix as a group.

10. The heating system according to claim 8, wherein one or more of said heater pixels comprises a temperature sensor, and wherein the controller is configured to receive sensor data from the temperature sensors of one or more heater pixels, and the controller is configured to control amount electrical power fed to the respective one or more heater pixels based on temperature detected by the respective temperature sensor.

11. The heating system according to claim 8, wherein the basic temperature is 19° C. or less.

12. The heating system according to claim 8, further comprising at least one sensor selected from the group comprising a moisture sensor, a capacitive sensor, a particle sensor, a strain sensor, a chemical sensor such as a volatile organic compound (VOC) sensor, and wherein the controller is further configured:
to determine, based on sensor signals received from one or more sensors, that the space is occupied, and
to activate operation of the heater matrix in response to said determining that the space is occupied.

13. The heating system according to claim 12, wherein the controller is further configured:
upon determining, that the space is occupied, to obtain sensor signals in effort to identify at least one person within the space, and
in response to identifying the at least one person, to obtain personalized settings of the identified person from a memory and to control operation of the heater matrix according to the personalized settings of the identified person, and
in response to none of the one or more persons occupying the space is identified, to obtain general settings from the memory and to control operation of the heater matrix according to the general settings.

14. The heating system according to claim 8, wherein settings of the heater matrix determine at least one heater pixel that is not to be activated due to being collocated with furniture.

15. The heating system according to claim 8, wherein the carrier material of heater pixels is one or more of a fiber based materials such as paper or cardboard, glass-fiber, carbon fiber, textiles, fabrics made of textiles, polymer fibers, fiber reinforced materials made with polymer fibers, laminates such as high-pressure laminates, glass fiber composites, polymeric materials, films, inorganic materials such as concrete and ceramics.

* * * * *